US009267716B2

(12) United States Patent
Song et al.

(10) Patent No.: US 9,267,716 B2
(45) Date of Patent: Feb. 23, 2016

(54) HEAT EXCHANGER AND AN AIR CONDITIONING SYSTEM HAVING THE SAME

(71) Applicant: LG Electronics Inc., Seoul (KR)

(72) Inventors: Chiwoo Song, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 280 days.

(21) Appl. No.: 13/756,926

(22) Filed: Feb. 1, 2013

(65) Prior Publication Data

US 2013/0219944 A1 Aug. 29, 2013

(30) Foreign Application Priority Data

Feb. 3, 2012 (KR) ..... 10-2012-0011309

(51) Int. Cl.

| | |
|---|---|
| ***F25B 49/02*** | (2006.01) |
| ***F25B 30/02*** | (2006.01) |
| ***F24F 1/14*** | (2011.01) |
| ***F25B 39/00*** | (2006.01) |
| ***F25B 41/04*** | (2006.01) |
| ***F28F 9/26*** | (2006.01) |
| ***F28D 1/053*** | (2006.01) |

(52) U.S. Cl.

CPC . *F25B 30/02* (2013.01); *F24F 1/14* (2013.01); *F25B 39/00* (2013.01); *F25B 41/04* (2013.01); *F25B 49/02* (2013.01); *F28D 1/05316* (2013.01); *F28F 9/262* (2013.01); *F28F 2250/06* (2013.01)

(58) Field of Classification Search

CPC ..... F25B 30/02; F25B 41/047; F25B 47/022; F25B 47/025; F28F 9/262; F24F 1/14

See application file for complete search history.

(56) References Cited

U.S. PATENT DOCUMENTS

| | | | | |
|---|---|---|---|---|
| 4,167,102 | A * | 9/1979 | Willitts | 62/152 |
| 4,565,070 | A * | 1/1986 | Raymond | 62/81 |
| 2004/0134205 | A1 * | 7/2004 | Park et al. | 62/151 |
| 2007/0137238 | A1 * | 6/2007 | Hu | 62/277 |

FOREIGN PATENT DOCUMENTS

| | | | | |
|---|---|---|---|---|
| JP | 2003-121019 | * | 4/2003 | F25B 1/13 |

* cited by examiner

*Primary Examiner* — Mohammad M Ali
*Assistant Examiner* — Christopher R Zerphey
(74) *Attorney, Agent, or Firm* — Dentons US LLP

(57) ABSTRACT

A heat exchanger included in an air conditioner includes a first header pipe to have a refrigerant, compressed by a compressor, to flow therein and a first heat exchange unit coupled to the first header pipe to receive the refrigerant flowing in the first header, a second header pipe to have the refrigerant to flow therein and a second heat exchange unit coupled to the second header pipe to receive the refrigerant flowing in the second header pipe in the air cooling operation. A bypass pipe couples the first heat exchange unit with the second header pipe and a bypass valve controls a flow of the refrigerant through the bypass pipe. A controller controls the bypass valve such that the refrigerant is allowed to flow from the first heat exchange unit to the second header pipe in the air cooling operation.

18 Claims, 4 Drawing Sheets

HEAT EXCHANGER AND AN AIR CONDITIONING SYSTEM HAVING THE SAME

CROSS-REFERENCE TO RELATED APPLICATION

This application claims the benefit of Korean Application No. 10-2012-0011309, filed on Feb. 3, 2012 in the Korean Intellectual Property Office, the disclosure of which is incorporated herein by reference.

BACKGROUND

1. Field of the Disclosure

The present disclosure relates to a heat exchanger and, more particularly, to a heat exchanger in which the passage of a refrigerant is varied in an air cooling operation and a heating operation.

2. Discussion of the Related Art

In general, an air conditioner is an apparatus configured to include a compressor, an outdoor heat exchanger, an expansion valve, and an indoor heat exchanger, to cool or heat the interior of a room using a refrigerating cycle. That is, the air conditioner may include a cooler for cooling the interior of a room and a heater for heating the interior of a room. The air conditioner may also be formed in a combination cooling and heating air conditioner for cooling or heating the interior of a room.

If the air conditioner is formed in the combination cooling and heating air conditioner, the air conditioner further includes a 4-way valve for changing the passage of a refrigerant, compressed by the compressor, depending on an air cooling operation or a heating operation. That is, in the air cooling operation, the 4-way valve is controlled by a controller such that the refrigerant compressed by the compressor flows through the 4-way valve into the outdoor heat exchanger, and the outdoor heat exchanger functions as a condenser. Next, the refrigerant condensed by the outdoor heat exchanger is expanded by the expansion valve, and the expanded refrigerant flows into the indoor heat exchanger. In this case, the indoor heat exchanger functions as an evaporator. Next, the refrigerant evaporated by the indoor heat exchanger flows into the compressor through the 4-way valve.

Meanwhile, in the heating operation, the 4-way valve is controlled such that the refrigerant compressed by the compressor flows through the 4-way valve into the indoor heat exchanger, and the indoor heat exchanger functions as a condenser. Next, the refrigerant condensed by the indoor heat exchanger is expanded by the expansion valve, and the expanded refrigerant flows into the outdoor heat exchanger. In this case, the outdoor heat exchanger functions as an evaporator. Next, the refrigerant evaporated by the outdoor heat exchanger flows into the compressor through the 4-way valve.

SUMMARY

One object is to provide a heat exchanger in which the passage of a refrigerant is varied in an air cooling operation and a heating operation.

Another object is to provide a heat exchanger which efficiently performs a defrosting operation of removing frost generated in the heat exchanger.

Objects to be achieved are not limited to the above-mentioned objects, and other objects that have not been described above will be evident to those skilled in the art from the following description.

In accordance with an embodiment of the present invention, there is provided an outdoor heat exchanger included in an air conditioner and to function as a condenser in an air cooling operation and to function as an evaporator in a heating operation, the heat exchanger comprising: a first header pipe to have a refrigerant, compressed by a compressor, to flow therein in the air cooling operation; a first heat exchange unit coupled to the first header pipe to receive the refrigerant flowing in the first header pipe and to thermally exchange the refrigerant with air in the air cooling operation; a second header pipe to have the refrigerant to flow therein; a second heat exchange unit coupled to the second header pipe to receive the refrigerant flowing in the second header pipe and to thermally exchange the refrigerant with air in the air cooling operation; a bypass pipe to couple the first heat exchange unit with the second header pipe; a bypass valve to control a flow of the refrigerant through the bypass pipe; and a controller to control the bypass valve such that the refrigerant is allowed to flow from the first heat exchange unit to the second header pipe in the air cooling operation.

In accordance with another embodiment of the present invention, an air conditioning system comprises a compressor; a first heat changer; a second heat changer to function as a condenser in an air cooling operation and to function as an evaporator in a heating operation, the second heat exchanger including: a first header pipe to have a refrigerant, compressed by the compressor, to flow therein in the air cooling operation; a first heat exchange unit coupled to the first header pipe to receive the refrigerant flowing in the first header pipe and to thermally exchange the refrigerant with air in the air cooling operation; a second header pipe to have the refrigerant to flow therein; a second heat exchange unit coupled to the second header pipe to receive the refrigerant flowing in the second header pipe and to thermally exchange the refrigerant with air in the air cooling operation; a bypass pipe to couple the first heat exchange unit with the second header pipe; a bypass valve to control a flow of the refrigerant through the bypass pipe; and a controller to control the bypass valve such that the refrigerant is allowed to flow from the first heat exchange unit to the second header pipe in the air cooling operation.

Details of other embodiments are included in the detailed description and drawings.

BRIEF DESCRIPTION OF THE DRAWINGS

The above and other objects and features of the present disclosure will become apparent from the following description of some embodiments given in conjunction with the accompanying drawings, in which.

DETAILED DESCRIPTION OF THE EMBODIMENTS

Merits and characteristics of the present disclosure and methods for achieving them will become more apparent from the following embodiments taken in conjunction with the accompanying drawings. However, the present invention is not limited to the disclosed embodiments, but may be implemented in various ways. The embodiments are provided for complete disclosure and to allow those having ordinary skill in the art to fully understand the principles of the present invention. The same reference numbers may be used throughout the drawings to refer to the same or like parts.

Hereinafter, embodiments of the present invention will be described in detail with reference to the accompanying drawings for describing an outdoor heat exchanger.

Figure 1:
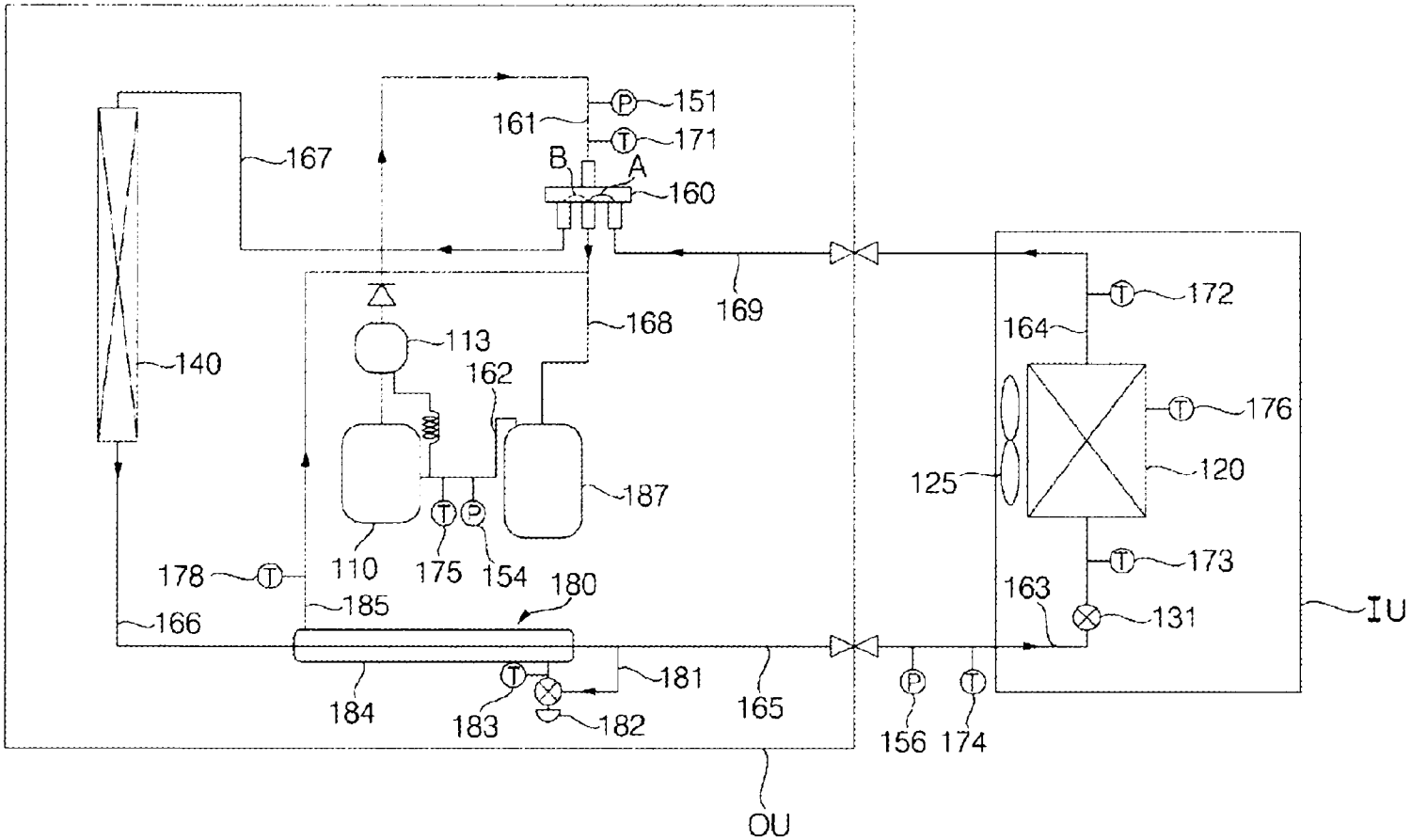
FIG. 1 shows the construction of an air conditioner according to an embodiment of the present invention.

FIG. 1 shows the construction of an air conditioner according to an embodiment of the present invention.

The air conditioner according to the embodiment of the present invention includes an outdoor unit OU and an indoor unit IU.

The outdoor unit OU includes a compressor 110, an outdoor heat exchanger 140, and a supercooler 180. The air conditioner may include one or a plurality of the outdoor units OU.

The compressor 110 compresses a refrigerant of a low temperature and low pressure into a refrigerant of a high temperature and high pressure. The compressor 110 may have various structures, and an inverter type compressor or a constant speed compressor may be adopted as the compressor 110. A discharge temperature sensor 171 and a discharge pressure sensor 151 are installed on a discharge pipe 161 of the compressor 110. Furthermore, a suction temperature sensor 175 and a suction pressure sensor 154 are installed on a suction pipe 162 of the compressor 110.

The outdoor unit OU is illustrated as including one compressor 110, but the present invention is not limited thereto. The outdoor unit OU may include a plurality of the compressors and may include both an inverter type compressor and a constant speed compressor.

An accumulator 187 may be installed in the suction pipe 162 of the compressor 110 in order to prevent a refrigerant of a liquid state from entering the compressor 110. An oil separator 113 for collecting oil from the refrigerant discharged from the compressor 110 may be installed in the discharge pipe 161 of the compressor 110.

A 4-way valve 160 is a passage switch valve that switches for cooling operation and heating operation. The 4-way valve 160 may be controlled by a controller. The 4-way valve 160 guides the refrigerant compressed by the compressor 110 to the outdoor heat exchanger 140 in an air cooling operation and guides the compressed refrigerant to an indoor heat exchanger 120 in a heating operation. The 4-way valve 160 is in an A state in the air cooling operation and is in a B state in the heating operation.

The outdoor heat exchanger 140 is disposed in an outdoor space, and the refrigerant passing through the outdoor heat exchanger 140 is thermally exchanged with outdoor air at the outdoor heat exchanger 140. The outdoor heat exchanger 140 functions as a condenser in an air cooling operation and functions as an evaporator in a heating operation.

The outdoor heat exchanger 140 is coupled to a first inflow pipe 166, which is coupled to the indoor unit IU through a liquid pipe 165. The outdoor heat exchanger 140 is coupled to a second inflow pipe 167, which is coupled to the 4-way valve 160.

The supercooler 180 includes a supercooling heat exchanger 184, a second bypass pipe 181, a supercooling expansion valve 182, and a discharge pipe 185. The supercooling heat exchanger 184 is disposed on the first inflow pipe 166. In an air cooling operation, the second bypass pipe 181 functions to bypass the refrigerant discharged from the supercooling heat exchanger 184 so that the discharged refrigerant flows in the supercooling expansion valve 182.

The supercooling expansion valve 182 is disposed on the second bypass pipe 181. The supercooling expansion valve 182 lowers the pressure and temperature of a refrigerant by constricting the refrigerant of a liquid state that flows in the second bypass pipe 181 and then forces the refrigerant to flow into the supercooling heat exchanger 184. The supercooling expansion valve 182 may be various types, and a linear expansion valve may be used as the supercooling expansion valve 182 in this embodiment. The supercooling expansion valve 182 may be controlled by the controller. A supercooling temperature sensor 183 for detecting temperature of the refrigerant constricted by the supercooling expansion valve 182 is installed on the second bypass pipe 181.

In an air cooling operation, a condensed refrigerant passing through the outdoor heat exchanger 140 is super-cooled through a thermal exchange with a refrigerant of low temperature, introduced through the second bypass pipe 181, in the supercooling heat exchanger 184, and the super-cooled refrigerant flows into the indoor unit IU.

The refrigerant passing through the second bypass pipe 181 is thermally exchanged in the supercooling heat exchanger 184, and the thermally exchanged refrigerant flows into the accumulator 187 through the discharge pipe 185. A discharge pipe temperature sensor 178 for detecting temperature of the refrigerant entering the accumulator 187 is installed on the discharge pipe 185.

A liquid pipe temperature sensor 174 and a liquid pipe pressure sensor 156 are installed on the liquid pipe 165 which couples the supercooler 180 and the indoor unit IU.

In the air conditioner according to the embodiment of the present invention, the indoor unit IU includes the indoor heat exchanger 120, an indoor fan 125, and an indoor expansion valve 131. The air conditioner may include one or a plurality of the indoor units IU.

The indoor heat exchanger 120 is disposed in an indoor space, and a refrigerant passing through the indoor heat exchanger 120 is thermally exchanged with indoor air at the indoor heat exchanger 120. The indoor heat exchanger 120 functions as an evaporator in an air cooling operation and functions as a condenser in a heating operation. An indoor temperature sensor 176 for detecting indoor temperature is installed in the indoor heat exchanger 120.

The indoor expansion valve 131 is an apparatus for constricting an inflow refrigerant in an air cooling operation. The indoor expansion valve 131 is installed in the indoor inlet pipe 163 of the indoor unit IU. The indoor expansion valve 131 may be various types, and a linear expansion valve may be used as the indoor expansion valve 131, in this embodiment. The indoor expansion valve 131 may be controlled by the controller. It is preferred that the indoor expansion valve 131 be opened in a set opening degree in an air cooling operation and be fully opened in a heating operation.

An indoor inlet pipe temperature sensor 173 is installed on the indoor inlet pipe 163. The indoor inlet pipe temperature sensor 173 may be installed between the indoor heat exchanger 120 and the indoor expansion valve 131. Furthermore, an indoor outlet pipe temperature sensor 172 is installed on the indoor outlet pipe 164.

In the air cooling operation of the above-described air conditioner, the flow of a refrigerant is described below.

A refrigerant of a high temperature and high pressure and in a gaseous state, discharged from the compressor 110, flows into the outdoor heat exchanger 140 through the 4-way valve 160 and the second inflow pipe 167. The refrigerant is thermally exchanged with outdoor air at the outdoor heat exchanger 140, and thus the refrigerant is condensed. The refrigerant drained from the outdoor heat exchanger 140 flows into the supercooler 180 through the first inflow pipe 166. Next, the refrigerant is super-cooled by the supercooling heat exchanger 184, and the super-cooled refrigerant flows into the indoor unit IU.

A part of the refrigerant super-cooled by the supercooling heat exchanger 184 is constricted by the supercooling expansion valve 182, so that the refrigerant passing through the supercooling heat exchanger 184 is super-cooled. The refrigerant super-cooled by the supercooling heat exchanger 184 flows into the accumulator 187.

The refrigerant flowing into the indoor unit IU is constricted by the indoor expansion valve 131 opened by a set opening degree and is then thermally exchanged with indoor air at the indoor heat exchanger 120, thus being evaporated. The evaporated refrigerant flows into the compressor 110 through the 4-way valve 160 and the accumulator 187.

In the heating operation of the above-described air conditioner, the flow of a refrigerant is described below.

A refrigerant of a high temperature and high pressure and in a gaseous state, discharged from the compressor 110, flows into the indoor unit IU through the 4-way valve 160. Here, the indoor expansion valves 131 of the indoor units IU are fully opened. The refrigerant drained from the indoor unit IU flows into the outdoor heat exchanger 140 through the first inflow pipe 166. Next, the refrigerant is thermally exchanged with outdoor air at the outdoor heat exchanger 140, thus being evaporated. The evaporated refrigerant flows into the suction pipe 162 of the compressor 110 through the 4-way valve 160 and the accumulator 187 through the second inflow pipe 167.

Figure 2:
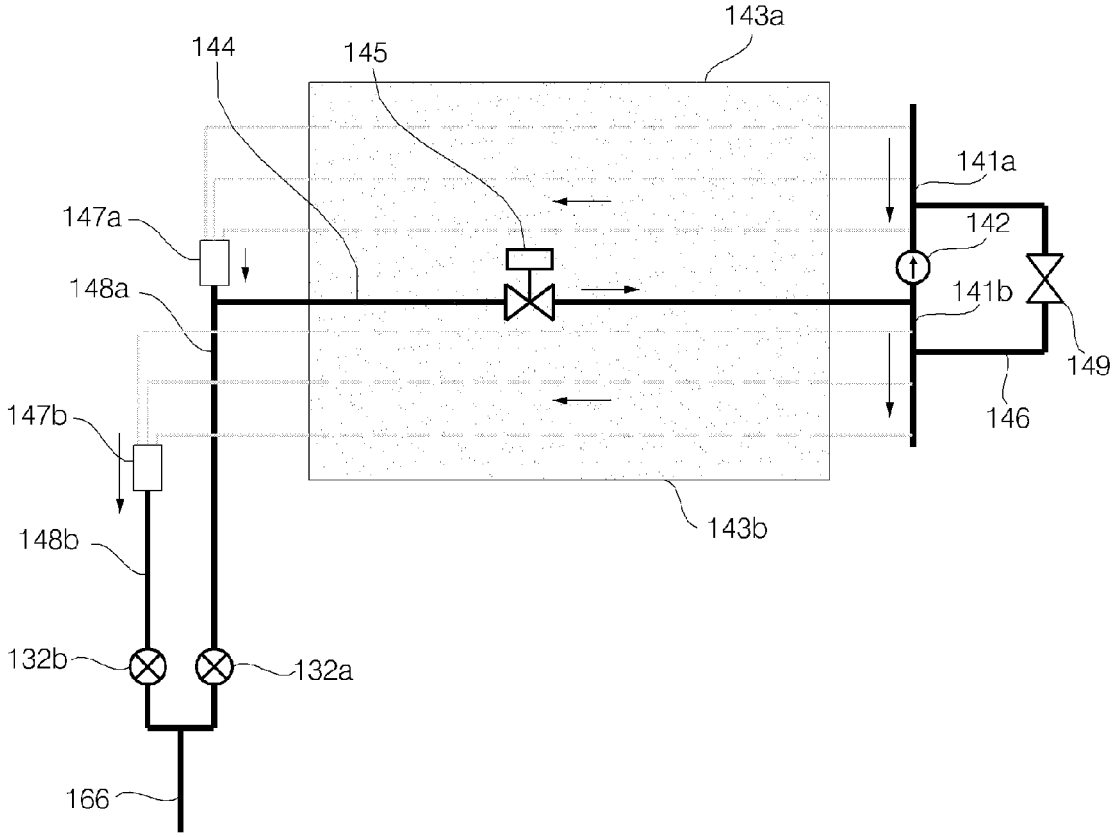
FIGS. 2 and 3 show the constructions of outdoor heat exchangers and flow of a refrigerant in an air cooling operation and in a heating operation according to embodiments of the present invention.
Figure 3:
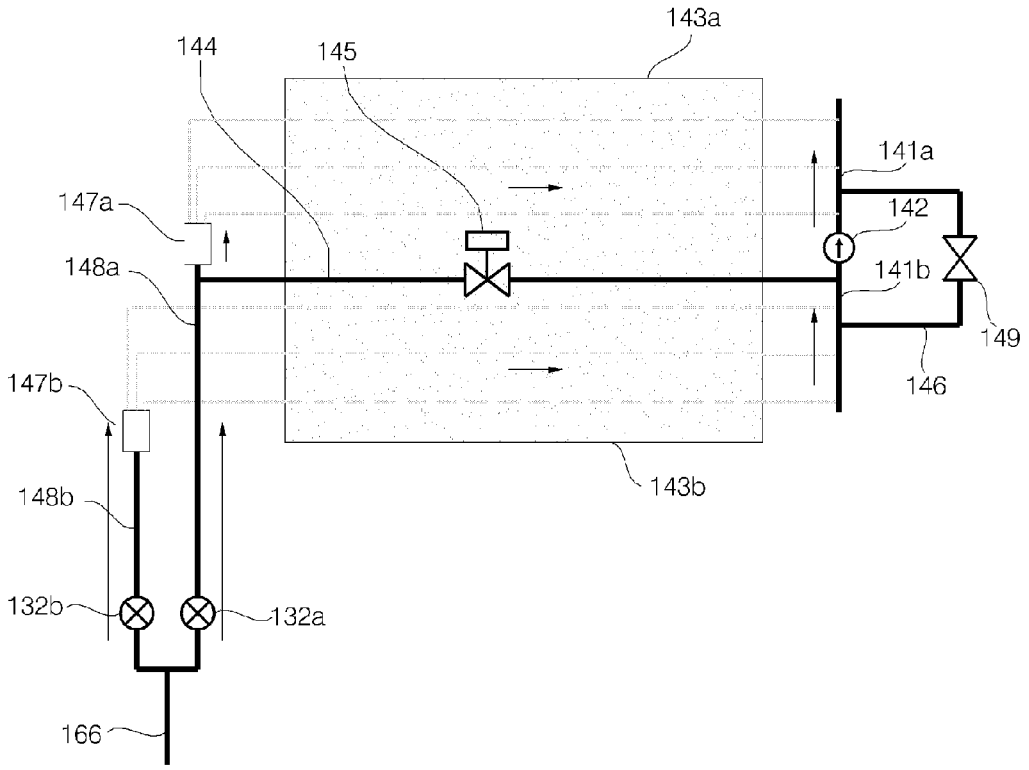

FIGS. 2 and 3 show the constructions of outdoor heat exchangers and flow of a refrigerant in an air cooling operation and in a heating operation according to embodiments of the present invention.

The outdoor heat exchanger 140 according to an embodiment of the present invention includes a first header pipe 141*a* configured to have a refrigerant, compressed by the compressor in an air cooling operation, flowed therein, a first heat exchange unit 143*a* coupled to the first header pipe 141*a* and configured to thermally exchange a refrigerant with air, a bypass pipe 144 configured to have a refrigerant, thermally exchanged in the first heat exchange unit 143*a* in an air cooling operation, passing therethrough, a first distribution pipe 148*a* coupled to the bypass pipe 144, a second header pipe 141*b* configured to have a refrigerant, passing through the bypass pipe 144 in an air cooling operation, flowed therein, a second heat exchange unit 143*b* coupled to a second header pipe 141*b* and configured to thermally exchange a refrigerant with air, a second distribution pipe 148*b* configured to have a refrigerant, thermally exchanged in the second heat exchange unit 143*b* in an air cooling operation, passing therethrough, a hot gas pipe 146 configured to couple the first header pipe 141*a* and the second header pipe 141*b*, and a hot gas valve 149 disposed in the hot gas pipe 146, which opens or closes in order to control the flow of a refrigerant. The hot gas valve 149 may be controlled by the controller.

The first header pipe 141*a* has one end coupled to the second inflow pipe 167, and thus coupled to the compressor 110. The first header pipe 141*a* has the other end coupled to the bypass pipe 144 and the second header pipe 141*b*. A check valve 142 is disposed at the other end of the first header pipe 141*a*. The check valve 142 controls the flow direction of a refrigerant so that the refrigerant from the first header pipe 141*a* is prevented from entering the second header pipe 141*b* and the refrigerant flows from the second header pipe 141*b* to the first header pipe 141*a*.

The first header pipe 141*a* is coupled to one end of the first heat exchange unit 143*a*. The first header pipe 141*a* is coupled to the plurality of refrigerant tubes of the first heat exchange unit 143*a*. That is, the first header pipe 141*a* is branched into the plurality of refrigerant tubes of the first heat exchange unit 143*a*.

The first heat exchange unit 143*a* has one end coupled to the first header pipe 141*a* and has the other end coupled to a first distributor 147*a*. The first heat exchange unit 143*a* includes a plurality of refrigerant tubes and a plurality of electric heat pins in which a refrigerant flows, and thus thermally exchanges the refrigerant with air. One ends of the plurality of refrigerant tubes of the first heat exchange unit 143*a* are merged into the first header pipe 141*a*, and the other ends thereof are merged into the first distributor 147*a*.

The first distributor 147*a* couples the other end of the first heat exchange unit 143*a* with the first distribution pipe 148*a*. The plurality of refrigerant tubes of the first heat exchange unit 143*a* are merged and coupled to the first distributor 147*a*.

The first distribution pipe 148*a* is coupled to the first distributor 147*a*. The first distribution pipe 148*a* is coupled to the other end of the first heat exchange unit 143*a* through the first distributor 147*a*. The first distribution pipe 148*a* is coupled to the first inflow pipe 166. The first distribution pipe 148*a* and the second distribution pipe 148*b* are merged into the first inflow pipe 166.

A first expansion valve 132*a* for controlling the degree of opening of the first distribution pipe 148*a* is disposed in the first distribution pipe 148*a*. The first expansion valve 132*a* may be controlled by the controller. The first expansion valve 132*a* may constrict, pass, or block a refrigerant passing through the first distribution pipe 148*a*. In an air cooling operation, the first expansion valve 132*a* is closed. In a heating operation, the degree of opening of the first expansion valve 132*a* is controlled in order to constrict a refrigerant. In a defrosting operation, the first expansion valve 132*a* is opened.

The bypass pipe 144 has one end coupled to the first distribution pipe 148*a* and has the other end coupled to the second header pipe 141*b*. A bypass valve 145 for controlling the flow of a refrigerant is disposed in the bypass pipe 144. The bypass valve 144 may be controlled by the controller. In an air cooling operation, the bypass valve 145 may be opened so that a refrigerant flows from the first distributor 147*a* to the second header pipe 141*b*. In a heating operation and a partial defrosting operation, the bypass valve 145 may be closed so that a refrigerant is prevented from flowing from the second header pipe 141*b* to the first distributor 147*a*.

In accordance with an embodiment, the bypass pipe 144 may be coupled to the first distributor 147*a* or may be coupled to the other end of the first heat exchange unit 143*a*.

The second header pipe 141*b* is coupled to the bypass pipe 144 and the first header pipe 141*a*. The second header pipe 141*b* is coupled to one end of the second heat exchange unit 143*b*. The second header pipe 141*b* is coupled to a plurality of refrigerant tubes of the second heat exchange unit 143*b*. That is, the second header pipe 141*b* is branched into the plurality of refrigerant tubes of the second heat exchange unit 143*b*.

The second heat exchange unit 143*b* has one end coupled to the second header pipe 141*b* and has the other end coupled to the second distributor 147*b*. The second heat exchange unit 143*b* includes the plurality of refrigerant tubes and the plurality of electric heat pins in which a refrigerant flows and thermally exchanges the refrigerant with air. One ends of the plurality of refrigerant tubes of the second heat exchange unit 143*b* are merged into the second header pipe 141*b*, and the other ends thereof are merged into the second distributor 147*b*.

The second heat exchange unit 143*b* is disposed beneath the first heat exchange unit 143*a*. That is, the first heat exchange unit 143*a* and the second heat exchange unit 143*b* may be vertically disposed, and they may share the plurality of electric heat pins.

The second distributor 147*b* couples the other end of the second heat exchange unit 143*b* with the second distribution pipe 148*b*. The plurality of refrigerant tubes of the second heat exchange unit 143*b* are merged and coupled to the second distributor 147*b*.

The second distribution pipe 148*b* is coupled to a second distributor 147*b*. The second distribution pipe 148*b* is coupled to the other end of the second heat exchange unit 143*b* through the second distributor 147*b*. The second distribution pipe 148*b* is merged with the first distribution pipe 148*a* and then coupled to the first inflow pipe 166.

A second expansion valve 132*b* for controlling the degree of opening of the second distribution pipe 148*b* is disposed in the second distribution pipe 148*b*. The second expansion valve 132*b* may be controlled by the controller. The second expansion valve 132*b* may constrict, pass, or block a refrigerant passing through the second distribution pipe 148*b*. In an air cooling operation and a defrosting operation, the second expansion valve 132*b* is opened. In a heating operation, the degree of opening of the second expansion valve 132*b* is controlled in order to constrict a refrigerant.

The hot gas pipe 146 couples the first header pipe 141*a* and the second header pipe 141*b*. The hot gas pipe 146 is branched from the second inflow pipe 167 to the first header pipe 141*a*.

The hot gas pipe 146 is coupled to the second header pipe 141*b*. It is preferred that the hot gas pipe 146 be coupled to a point where the first header pipe 141*a* is coupled in the second header pipe 141*b*. That is, it is preferred that the hot gas pipe 146 be coupled to a point where the second header pipe 141*b* and the bypass pipe 144 are coupled.

The hot gas valve 149, which opens or closes in order to control the flow of a refrigerant is disposed in the hot gas pipe 146. In an air cooling operation, the hot gas valve 149 is closed. In a defrosting operation, the hot gas valve 149 is opened so that a refrigerant can flow from the first header pipe 141*a* to the second header pipe 141*b*. In a heating operation, the hot gas valve 149 may be opened or closed.

In accordance with an embodiment, an auxiliary valve (not shown), which opens or closes in order to control the flow of a refrigerant may be disposed in the second header pipe 141*b*. The auxiliary valve may be controlled by the controller. It is preferred that the auxiliary valve be disposed at a point where the bypass pipe 144 is coupled in the second header pipe 141*b*. In an air cooling operation and a heating operation, the auxiliary valve is opened. In a defrosting operation, the auxiliary valve is closed so that a refrigerant flowing through the second header pipe 141*b* is prevented from flowing in the bypass pipe 144.

In the air cooling operation of the above-described outdoor heat exchanger, the flow of a refrigerant is described below with reference to FIG. 2.

A refrigerant compressed by the compressor 110 flows in the first header pipe 141*a* through the second inflow pipe 167. The check valve 142 prevents the refrigerant flowing in the first header pipe 141*a* from flowing into the second header pipe 141*b*. In the air cooling operation, the hot gas valve 149 is closed, and thus the refrigerant flowing in the first header pipe 141*a* flows into the first heat exchange unit 143*a*.

The refrigerant flowing in the first heat exchange unit 143*a* is condensed through a thermal exchange with air. The refrigerant condensed by the first heat exchange unit 143*a* flows into the first distribution pipe 148*a* through the first distributor 147*a*. In an air cooling operation, the first expansion valve 132*a* is closed. Thus, the refrigerant flowing in the first distribution pipe 148*a* does not flow into the first inflow pipe 166, but flows into the bypass pipe 144.

In an air cooling operation, the bypass valve 145 is opened so that the refrigerant passing through the bypass pipe 144 flows into the second header pipe 141*b*. The refrigerant flowing in the second header pipe 141*b* flows into the second heat exchange unit 143*b*.

The refrigerant flowing in the second heat exchange unit 143*b* is condensed again through a thermal exchange with air. The refrigerant condensed by the second heat exchange unit 143*b* flows into the second distribution pipe 148*b* through the second distributor 147*b*. In an air cooling operation, the second expansion valve 132*b* is fully opened. Thus, the refrigerant flowing in the first inflow pipe 166 flows into the indoor unit IU through the first inflow pipe 166 and the liquid pipe 165.

In the heating operation of the above-described outdoor heat exchanger, the flow of a refrigerant is described below with reference to FIG. 3.

A refrigerant condensed by the indoor heat exchanger 120 of the indoor unit IU flows into the first inflow pipe 166 through the liquid pipe 165. The refrigerant flowing in the first inflow pipe 166 flows into the first distribution pipe 148*a* and the second distribution pipe 148*b*.

The refrigerant flowing in the second distribution pipe 148*b* is expanded by the second expansion valve 132*b* having an opening degree controlled. The refrigerant expanded by the second expansion valve 132*b* flows into the second heat exchange unit 143*b* through the second distributor 147*b*. The refrigerant flowing in the second heat exchange unit 143*b* is evaporated through a thermal exchange with air. The refrigerant evaporated by the second heat exchange unit 143*b* flows into the second header pipe 141*b*.

In the heating operation, the bypass valve 145 is closed so that the refrigerant flowing in the second header pipe 141*b* does not pass through the bypass pipe 144. The refrigerant flowing in the second header pipe 141*b* flows into the first header pipe 141*a* through the check valve 142. In the air cooling operation, if the hot gas valve 149 is opened, the refrigerant flowing in the second header pipe 141*b* may flow in the first header pipe 141*a* through the hot gas pipe 146.

Meanwhile, the refrigerant flowing in the first distribution pipe 148*a* is expanded by the first expansion valve 132*a*. In the heating operation, the bypass valve 145 is closed. Thus, the refrigerant expanded by the first expansion valve 132*a* does not flow into the second header pipe 141*b*, but flows into the first heat exchange unit 143*a* through the first distributor 147*a*. The refrigerant flowing in the first heat exchange unit 143*a* is evaporated through a thermal exchange with air.

The refrigerant evaporated by the first heat exchange unit 143*a* flows into the first header pipe 141*a*. The refrigerant flowing in the first header pipe 141*a* is merged with the refrigerant passing through the second header pipe 141*b*. Next, the merged refrigerant flows into the second inflow pipe 167 and then flows into the compressor 110.

Figure 4:
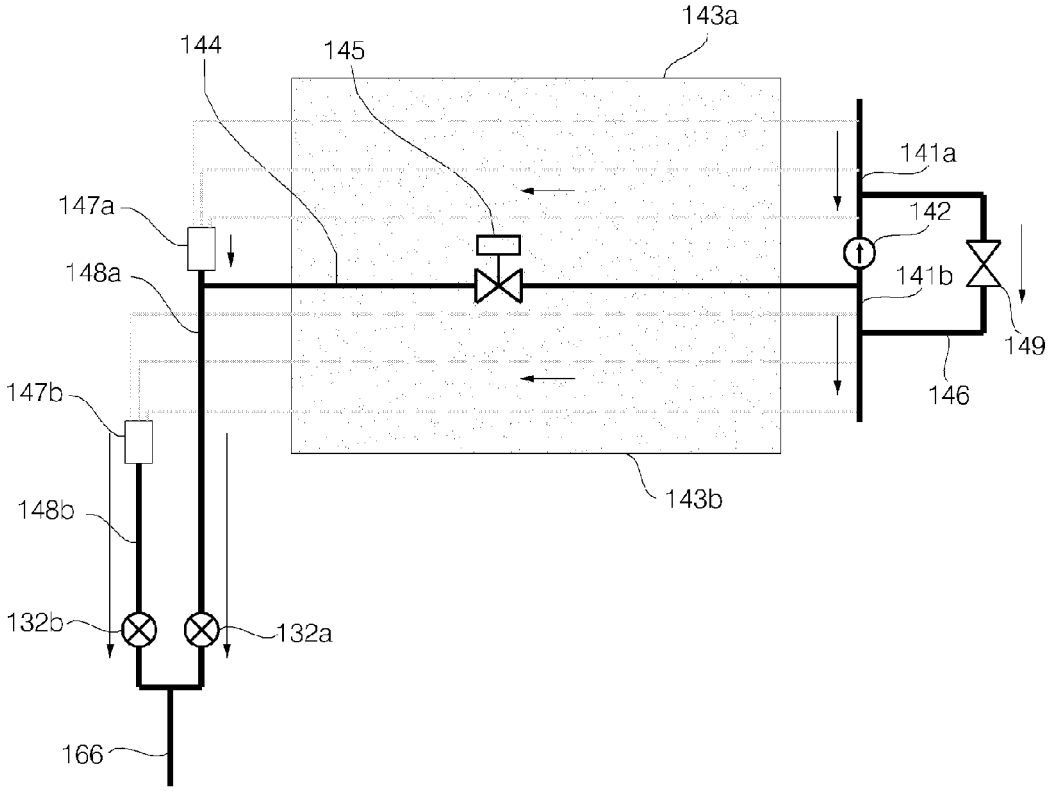
FIG. 4 is a diagram showing the flow of a refrigerant in the defrosting operation of the outdoor heat exchanger according to an embodiment of the present invention.

FIG. 4 is a diagram showing the flow of a refrigerant in the defrosting operation of the outdoor heat exchanger according to an embodiment of the present invention.

In a heating operation, if outdoor temperature is very low, frost may be generated in the outdoor heat exchanger 140. In this case, a defrosting operation for removing the frost generated in the outdoor heat exchanger 140 may be performed. In this case, the flow of a refrigerant is described below.

A refrigerant compressed by the compressor 110 flows into the first header pipe 141*a* through the second inflow pipe 167. Furthermore, in the defrosting operation, the hot gas valve 149 is opened, so that the refrigerant compressed by the compressor 110 flows into the second header pipe 141*b* through the second inflow pipe 167 and the first header pipe 141*a*. That is, when the hot gas valve 149 is opened, a part of the refrigerant flowing in the first header pipe 141*a* flows into the second header pipe 141*b*.

The refrigerant flowing in the first header pipe 141*a* flows into the first heat exchange unit 143*a*. The refrigerant flowing in the first heat exchange unit 143*a* flows through the first heat exchange unit 143*a* and heats the first heat exchange unit 143*a*, thus removing frost.

After flowing through the first heat exchange unit 143*a*, the refrigerant flows into the first distribution pipe 148*a* through the first distributor 147*a*. In the defrosting operation, the bypass valve 145 is closed, and the first expansion valve 132*a* is fully opened. Accordingly, the refrigerant flowing in the first distribution pipe 148*a* flows into the first inflow pipe 166.

In the defrosting operation, the refrigerant flowing in the second header pipe 141*b* does not pass through the bypass pipe 144 because the bypass valve 145 is closed. Accordingly, the refrigerant flowing in the second header pipe 141*b* flows into the second heat exchange unit 143*b*. The refrigerant flowing in the second heat exchange unit 143*b* flows through the second heat exchange unit 143*b* and heats the second heat exchange unit 143*b*, thus removing frost.

After flowing through the second heat exchange unit 143*b*, the refrigerant flows into the second distribution pipe 148*b* via the second distributor 147*b*. In the defrosting operation, the refrigerant flowing in the second distribution pipe 148*b* flows into the first inflow pipe 166 because the second expansion valve 132*b* is fully opened.

The outdoor heat exchanger according to the embodiments of the present invention has one or more of the following advantages.

First, there is an advantage in that the passage of a refrigerant is varied in an air cooling operation and a heating operation.

Second, there is an advantage in that the plurality of heat exchange units may be uniformly defrosted.

Third, there is an advantage in that the defrosting operation may be efficiently performed.

Effects according to embodiments of the present invention are not limited to the above-mentioned effects, and other effects that have not been described above will be evident to those skilled in the art from the following description.

The heat exchanging unit may be used in residential air conditioners, commercial air conditioners, and vehicles, such as cars and trucks. Vehicles such as electric cars and hybrid cars may take advantage of the air conditioners using the heat exchanging unit.

Furthermore, although the preferred embodiments of the present invention have been illustrated and described, the present invention is not limited to the above specific embodiments, and a person having ordinary skill in the art to which the invention belongs may modify the embodiments in various ways without departing from the gist of the present invention which is claimed in the claims. The modified embodiments should not be interpreted individually from the technical spirit or prospect of the present invention.

What is claimed is:

1. A heat exchanger included in an air conditioner to function as a condenser in an air cooling operation and to function as an evaporator in a heating operation, the heat exchanger comprising:

a first header pipe to have a refrigerant that is compressed by a compressor to flow therein in the air cooling operation;

a first heat exchange unit coupled to the first header pipe to receive the refrigerant flowing in the first header pipe and to thermally exchange the refrigerant with air in the air cooling operation;

a second header pipe to have the thermally exchanged refrigerant from the first heat exchange unit to flow therein;

a second heat exchange unit coupled to the second header pipe to receive the refrigerant flowing in the second header pipe and to thermally exchange the refrigerant with air in the air cooling operation;

a bypass pipe to couple the first heat exchange unit with the second header pipe;

a bypass valve to control a flow of the refrigerant through the bypass pipe;

a controller to control the bypass valve such that the refrigerant is allowed to flow from the first heat exchange unit to the second header pipe in the air cooling operation;

a hot gas pipe to couple the first header pipe with the second header pipe; and a hot gas valve to control a flow of the refrigerant through the hot gas pipe;

wherein a downstream end of the first header pipe is coupled to an upstream end of the second header pipe, wherein an upstream end of the first header pipe is connected to the compressor, and the heat exchanger further comprises a check valve to prevent the refrigerant from flowing from the first header pipe to the second header pipe, wherein a first end of the hot gas pipe is connected to the first header pipe at a first location and a second end of the hot gas pipe is connected to the second header pipe at a second location, wherein the bypass pipe is connected to the second header pipe at a location between the first location and the second location, and wherein the check valve is disposed between the first location and the second location.

2. The outdoor heat exchanger of claim 1, further comprising:

a first distribution pipe coupled to the bypass pipe and the first heat exchange unit;

a second distribution pipe coupled to the second heat exchange unit to have the refrigerant that is thermally exchanged in the second heat exchange unit to pass therethrough in the air cooling operation;

a first expansion valve to control a flow of the refrigerant through the first distribution pipe;

a second expansion valve to control a flow of the refrigerant through the second distribution pipe; and the controller to control the first expansion valve such that the refrigerant is prevented from flowing through the first distribution pipe in the air cooling operation, and control the second expansion valve such that the refrigerant is allowed to flow through the second distribution pipe in the air cooling operation.

3. The heat exchanger of claim 2, wherein:

the first distribution pipe to have the refrigerant, condensed by another heat exchanger, to flow therein in the heating operation;

the second distribution pipe to have the refrigerant, condensed by the another heat exchanger, to flow therein in the heating operation;

the first expansion valve to control a flow of the refrigerant through the first distribution pipe;

the second expansion valve to control a flow of the refrigerant through the second distribution pipe; and the controller to control the first expansion valve such that the refrigerant is allowed to flow through the first distribution pipe into the first heat exchange unit, and the refrigerant is discharged from the first header pipe after being evaporated by the first heat exchange unit, in the heating operation, and to control the second expansion valve such that the refrigerant is allowed to flow through the second distribution pipe into the second heat exchange unit, and the refrigerant is discharged from the second header pipe after being evaporated by the second heat exchange unit, in the heating operation.

4. The heat exchanger of claim 3, wherein the controller controls the bypass valve such that the refrigerant is prevented from flowing through the bypass pipe in the heating operation.

5. The heat exchanger of claim 4, wherein the first expansion valve expands the refrigerant flowing in the first distribution pipe, and the second expansion valve expands the refrigerant flowing in the second distribution pipe.

6. The heat exchanger of claim 5, wherein:

the first header pipe to have the refrigerant, compressed by the compressor, to flow therein in the defrosting operation;

the first heat exchange unit coupled to the first header pipe to receive the refrigerant flowing in the first header pipe and to heat the first heat exchange unit in the defrosting operation;

the second header pipe to have the refrigerant, compressed by the compressor, to flow therein in the defrosting operation;

the second heat exchange unit coupled to the second header pipe to receive the refrigerant flowing in the second header pipe and to heat the second heat exchange unit in the defrosting operation; and the controller controls the bypass valve such that the refrigerant is prevented from flowing in the bypass pipe.

7. The heat exchanger of claim 6, wherein:

the controller controls the first expansion valve such that the refrigerant is allowed to discharge through the first distribution pipe in the defrosting operation, and controls the second expansion valve such that the refrigerant is allowed to discharge through the second distribution pipe in the defrosting operation.

8. The outdoor heat exchanger of claim 7, wherein the second heat exchange unit is disposed beneath the first heat exchange unit.

9. An air conditioning system comprising:

a compressor;

a first heat changer;

a second heat changer to function as a condenser in an air cooling operation and to function as an evaporator in a heating operation, the second heat exchanger including:

a first header pipe to have a refrigerant that is compressed by the compressor to flow therein in the air cooling operation;

a first heat exchange unit coupled to the first header pipe to receive the refrigerant flowing in the first header pipe and to thermally exchange the refrigerant with air in the air cooling operation;

a second header pipe to have the thermally exchanged refrigerant from the first heat exchange unit to flow therein;

a second heat exchange unit coupled to the second header pipe to receive the refrigerant flowing in the second header pipe and to thermally exchange the refrigerant with air in the air cooling operation;

a bypass pipe to couple the first heat exchange unit with the second header pipe;

a bypass valve to control a flow of the refrigerant through the bypass pipe;

a controller to control the bypass valve such that the refrigerant is allowed to flow from the first heat exchange unit to the second header pipe in the air cooling operation;

a hot gas pipe to couple the first header pipe with the second header pipe; and a hot gas valve to control a flow of the refrigerant through the hot gas pipe;

wherein a downstream end of the first header pipe is coupled to an upstream end of the second header pipe, wherein an upstream end of the first header pipe is connected to the compressor, and the heat exchanger further comprises a check valve to prevent the refrigerant from flowing from the first header pipe to the second header pipe, wherein a first end of the hot gas pipe is connected to the first header pipe at a first location and a second end of the hot gas pipe is connected to the second header pipe at a second location, wherein the bypass pipe is connected to the second header pipe at a location between the first location and the second location, and wherein the check valve is disposed between the first location and the second location.

10. The air conditioning system of claim 9, further comprising:

a first distribution pipe coupled to the bypass pipe and the first heat exchange unit;

a second distribution pipe coupled to the second heat exchange unit to have the refrigerant that is thermally exchanged in the second heat exchange unit to pass therethrough in the air cooling operation;

a first expansion valve to control a flow of the refrigerant through the first distribution pipe;

a second expansion valve to control a flow of the refrigerant through the second distribution pipe; and the controller to control the first expansion valve such that the refrigerant is prevented from flowing through the first distribution pipe in the air cooling operation, and control the second expansion valve such that the refrigerant is allowed to flow through the second distribution pipe to the first heat exchanger in the air cooling operation.

11. The air conditioning system of claim 10, wherein:

the first distribution pipe is configured to have the refrigerant condensed by the first heat exchanger to flow therein in the heating operation;

the second distribution pipe is configured to have the refrigerant condensed by the first heat exchanger to flow therein in the heating operation;

the first expansion valve is configured to control a flow of the refrigerant through the first distribution pipe;

the second expansion valve is configured to control a flow of the refrigerant through the second distribution pipe; and the controller is configured to control the first expansion valve such that the refrigerant is allowed to flow through the first distribution pipe into the first heat exchange unit, and the refrigerant is discharged from the first header pipe after being evaporated by the first heat exchange unit, in the heating operation, and to control the second expansion valve such that the refrigerant is allowed to flow through the second distribution pipe into the second heat exchange unit, and the refrigerant is discharged from the second header pipe after being evaporated by the second heat exchange unit, to the compressor in the heating operation.

12. The air conditioning system of claim 11, wherein the controller controls the bypass valve such that the refrigerant is prevented from flowing through the bypass pipe in the heating operation.

13. The air conditioning system of claim 11, wherein the first expansion valve expands the refrigerant flowing in the first distribution pipe, and the second expansion valve expands the refrigerant flowing in the second distribution pipe.

14. The air conditioning system of claim 13, wherein:

the first header pipe is configured to have the refrigerant, compressed by the compressor, to flow therein in the defrosting operation;

the first heat exchange unit is coupled to the first header pipe to receive the refrigerant flowing in the first header pipe and configured to heat in the defrosting operation;

the second header pipe is configured to have the refrigerant compressed by the compressor to flow therein in the defrosting operation;

the second heat exchange unit is coupled to the second header pipe to receive the refrigerant flowing in the second header pipe and configured to heat in the defrosting operation; and the controller controls the bypass valve such that the refrigerant is prevented from flowing in the bypass pipe.

15. The air conditioning system of claim 14, wherein:

the controller controls the first expansion valve such that the refrigerant is allowed to discharge through the first distribution pipe in the defrosting operation, and controls the second expansion valve such that the refrigerant is allowed to discharge through the second distribution pipe in the defrosting operation.

16. The air conditioning system of claim 15, wherein the second heat exchange unit is disposed beneath the first heat exchange unit.

17. The outdoor heat exchanger of claim 8, wherein the controller controls the hot gas valve such that the refrigerant is prevented from flowing from the first header pipe to the second header pipe in the air cooling operation.

18. The outdoor heat exchanger of claim 16, wherein the controller controls the hot gas valve such that the refrigerant is prevented from flowing from the first header pipe to the second header pipe in the air cooling operation.

* * * * *